United States Patent [19]

Shigemori et al.

[11] 3,974,499

[45] Aug. 10, 1976

[54] CONTACTLESS BUZZER

[75] Inventors: Youjiro Shigemori; Yoshio Mitumori, both of Shizuoka, Japan

[73] Assignee: Star Seimitsu Kabushiki Kaisha, Japan

[22] Filed: Dec. 6, 1974

[21] Appl. No.: 530,410

[30] Foreign Application Priority Data

| | | |
|---|---|---|
| Dec. 12, 1973 | Japan | 48-144362 |
| Dec. 14, 1973 | Japan | 48-141504 |
| Feb. 18, 1974 | Japan | 49-19948 |

[52] U.S. Cl. ..... 340/392; 340/384 E; 340/384 R; 340/396; 340/388

[51] Int. Cl.[2] ..... G10K 1/00

[58] Field of Search ..... 340/384 E, 384 R, 396, 340/388, 392

[56] References Cited

UNITED STATES PATENTS

| | | | |
|---|---|---|---|
| 3,277,465 | 10/1966 | Potter | 340/384 R |
| 3,341,841 | 9/1967 | Stampfli | 340/384 E |
| 3,425,057 | 1/1969 | Doggart | 340/396 X |

*Primary Examiner*—Harold I. Pitts
*Attorney, Agent, or Firm*—Holman & Stern

[57] ABSTRACT

This invention relates to contactless buzzer unit wherein audible signals are delivered by mechanical blows of a resonator membrane by an electromagnetically driven vibrator fed from an electronic circuit with oscillating voltage pulses. A base section is provided by an electromagnetic drive unit having an iron core and a drive coil fixedly mounted on a base plate, while a casing section is provided by an audio-signaling unit including the resonator membrane, a spacer and a vibrator assembled together and attached to a case member. Both these sections are assembled together and to the case member molded with plastic material into one piece which is provided with stud posts extending from two precisely formed, precisely and mutually, precisely parallel planes formed on the case member and serving for the assembly of these sections as guiding, positioning and fixing means.

3 Claims, 16 Drawing Figures

CONTACTLESS BUZZER

BACKGROUND OF THE INVENTION

This invention relates to improvements in a contactless buzzer unit.

One example of prior art contactless buzzers has a loud speaker as the audible signal delivery means. Piezoelectrically driven buzzers are also known to the prior art.

The invention disclosed herein relates to buzzer wherein a coil is periodically energized for correspondingly magnetizing an iron core which electromagnetically cooperates therewith and for correspondingly oscillating an oscillative membrane, which oscillations are caused by said intermittently and periodically imposed magnetization, said oscillator or vibrator being caused to strike a resonator membrane cooperating therewith.

SUMMARY OF THE INVENTION

An object of the present invention is to provide a contactless buzzer unit of the aforementioned kind which represents a highly stabilized tone quality without any adjustment for temperature compensation and the like A further object of the invention is to provide an improved contactless buzzer unit of the above kind which is easy to manufacture in a mass production base and adapted for automatic assembly of it constituent parts.

A still further object of the invention is to provide an improved contactless buzzer unit of the above kind which is of low price and represents a longer durable life.

These and further objects, features and advantages of the invention will become more apparent when reading the following detailed description of a preferred embodiment of the invention in with a comparable conventional embodiment.

DETAILED DESCRIPTION OF THE INVENTION

Referring now to the accompanying drawings, a preferred embodiment of the invention will be described in detail.

Figure 1:
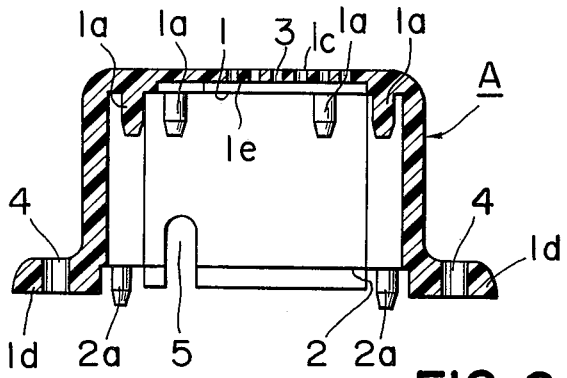
FIG. 1 is a sectional elevation of a case member which constitutes a constituent of the buzzer unit of the invention.
Figure 2:
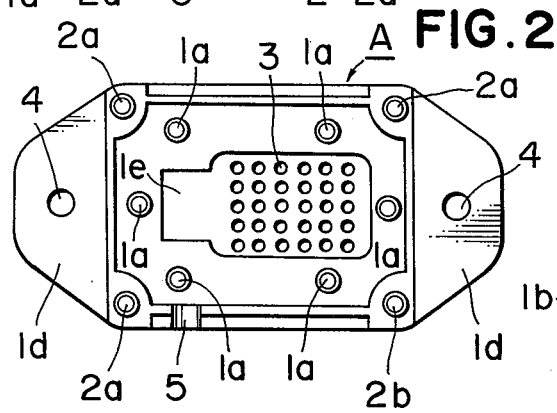
FIG. 2 is an inverted bottom view thereof.

A buzzer case shown at "A" in FIGS. 1 and 2 is made from hard plastic such as, preferably, epoxy-, phenol or the like resin, into a top-closed, bottom-opened cup-shaped member which has two bottom end flanges 1*d* formed with two or more bolt openings 4.

Within inside of said casing A, the latter is formed with two precisely parallel plane surfaces 1 and 2 at a precise predetermined mutual distance. On the first upper level surface 1, a plurality of, herein six, rigid stud posts 1*a* are provided in an integrally and downwardly depending mode, which posts serve for guidance and attachment of an audio-signaling unit to be described. In the similar way, four corner posts 2*a* are provided on the second and lower surface 2 in an integrally depending mode, for guidance and attachment of a base section to be described, which carries an electromagnetic drive circuit unit, as will be later more fully described.

A number of small sound-delivery openings 3 are formed through the ceiling portion 1*c* of the case member A defining said first upper surface 1, in a region set in relief from the surface. Numeral 5 represents a recess or opening formed through one of the side parallel walls of the case A for introducing electrical leads, not shown, into the interior space thereof.

Figure 3:
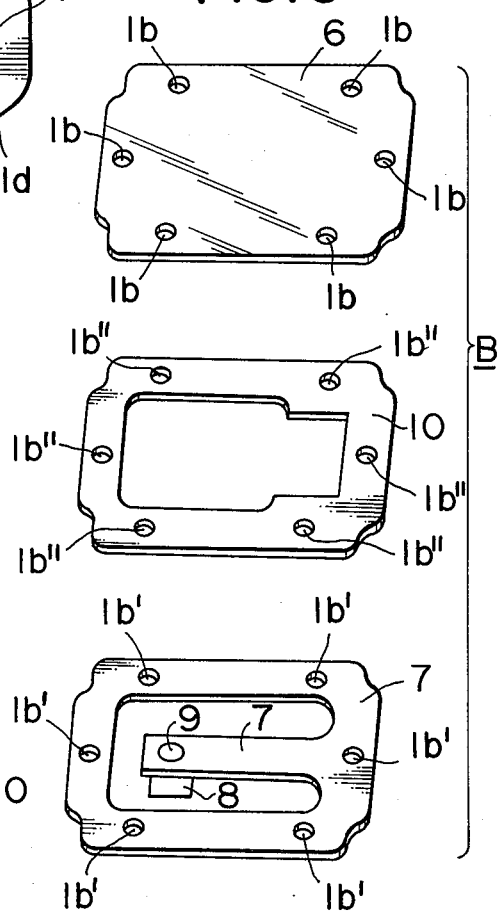
FIG. 3 is an exploded perspective view of three constituting parts forming in combination an audible signal delivery section comprised in the buzzer unit embodiment.
Figure 4:
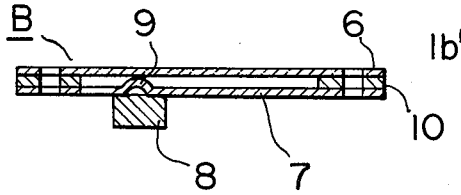
FIG. 4 is a sectional elevation of the audible signal delivery section in its assembled position.

Several constituent parts of the audio-signaling unit are shown at "B" in their exploded perspective view in FIG. 3. This unit B is also shown in its assembled section in FIG. 4.

Numeral 6 represents a flat and thin resonance plate which is made of an elastic metal, preferably steel, and takes a thin yoke shape as shown.

Numeral 7 represents a vibrator comprising a permanent magnet or soft iron piece 8, a striker projection 9 being formed integrally on the vibrator proper, which is formed into an oscillatory tongue.

Numeral 10 represents a spacer piece arranged between the resonance plate and the vibrator unit for maintaining a proper idle gap therebetween, said spacer having a precisely coinciding outer configuration to those of the plate 6 and vibrator 7, and a hollow central portion. This spacer is formed with a plurality of openings 1b'' in registration with said stud posts 1a for reception thereof. Groups of openings 1b and 1b' are formed through the members 6 and 10, respectively, to serve for the same stud reception purpose.

These constituents 6, 10 and 7 are assembled to the case member A by being guided by the depending stud posts 1a at the bottom surface 1e of said ceiling portion 1c and the exposing lower ends of these posts are welded to the sub-assembly constituting the signaling unit B by the ultrasonic welding technique, as a preferable means.

Figure 5:
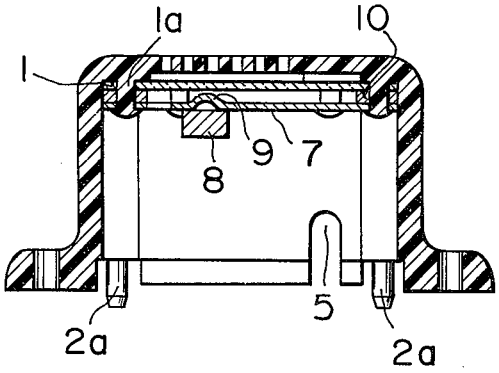
FIG. 5 is a sectional elevation of a first sub-assembly comprising said case member and said audible signal delivery section assembled together to provide a casing section.

The thus provided combination shown at FIG. 5 of the sub-units A and B provides a case section "I" as shown in its section in FIG. 5. In this case section, I, there is normally provided a predetermined operating gap between striker projection 9 on the vibrator 7, on the one hand, and resonance plate 6, on the other.

Figure 6:
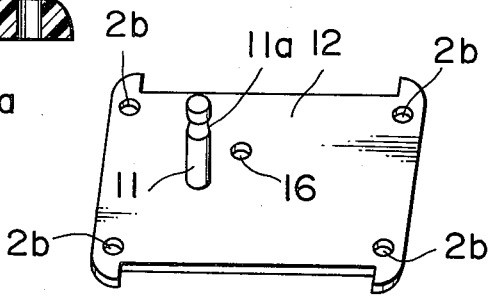
FIG. 6 is a perspective view of a base plate comprised in the buzzer unit and fitted with an iron core rod press-fit at its root end to said base plate.

A base section comprises a base plate 12 punched out from a metallic, preferably iron sheet, not shown, a rod-like iron core 11 being press-fit at its root end into the material of the base plate, as shown in FIG. 6. This base plate 12 is perforated at 2b to be in registration with the stud posts 2a on the case member A.

Figure 7:
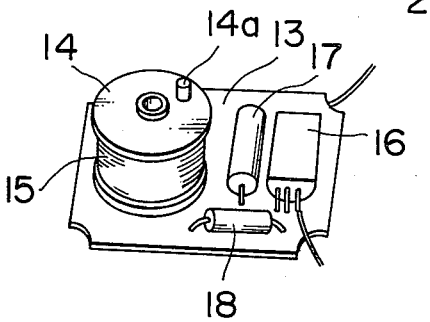
FIG. 7 is a perspective view of an electromagnetic driver employed.
Figure 8:
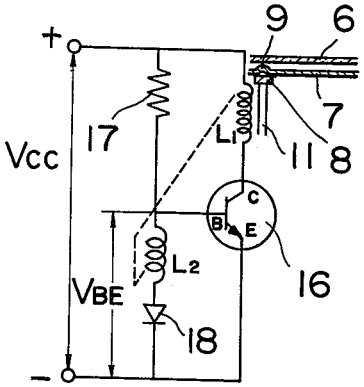
FIG. 8 is a schematic diagram of an electronic circuit representing said electromagnetic driver shown in FIG. 7.

The electromagnetic drive circuit unit shown at FIG. 7 comprises a printed circuit board 13 which mounts a bobbin 14 having a coil assembly 15 wound thereon; a transistor 16, a resistor 17 and a diode 18 electrically connected as shown in FIG. 8. The coil assembly 15 comprises a drive coil section $L_1$ and a sensing coil section $L_2$ wound in a bifilar mode.

Figure 9:
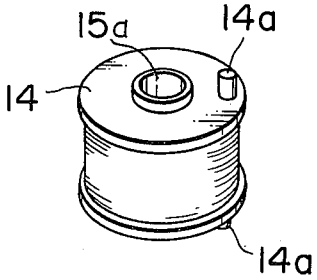
FIG. 9 is a perspective view of a bobbin to be wound with an operating coil.
Figure 10:
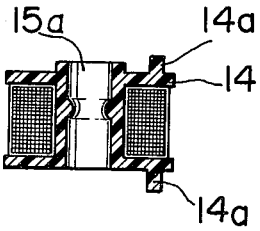
FIG. 10 is a sectional elevation of said bobbin which is, however, wound with said coil shown only in a highly schematic way.
Figure 11:
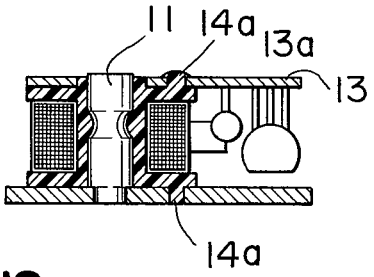
FIG. 11 is a schematic sectional elevation of a second main section of the buzzer unit and comprising said electromagnetic driver circuit and a base plate assembled with the latter for mounting and positioning thereof.
Figure 12:
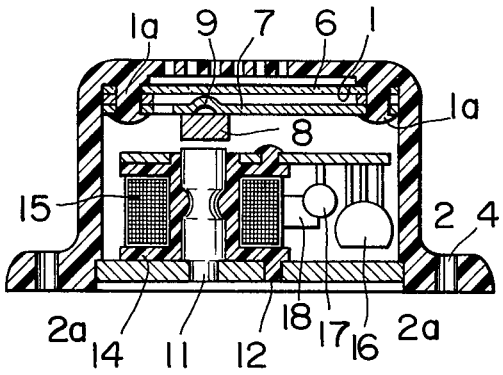
FIG. 12 is a schematic sectional elevation of said buzzer unit, wherein, however, certain parts have been represented only in a symbolized way.

The bobbin 14 is provided an upper and a lower projection shown commonly by 14a as illustrated in FIGS. 9, 10 and 11 and by utilization of these projections, the printed circuit board 13 and the base plate 12 are attached to the coil-bobbin unit 14, as shown in FIG. 11. The projecting heads of these projections are flattened, preferably under heat and pressure. For this purpose, the base plate 12 is perforated at 16. The board 13 is also perforated similarly, as may be seen in FIG. 11.

As seen from FIG. 10, the bobbin is formed with a central bore 15a which receives the iron core 11. The thus provided base section II is clearly seen at FIG. 11. The board 13 is formed with a perforation in registration with said central bore 15a although not shown.

The iron core rod 11 is formed with a ring recess 11a adapted for engagement with one or more inner lateral projection or projections 14b serving as positioning means.

In the final assembly job, the base section II is assembled with the casing section I under utilization of guide-and-engaging projections or stud posts 2a projecting from the second and lower surface 2 of the case member 1 by bringing these posts into full and perfect registration with the corresponding guide-and-reception openings 2b perforated through the base plate 12, so as to provide a contactless buzzer according to the present invention.

In the present contactless buzzer, with the provision of the two precisely parallel upper and lower reference planes 1 and 2 within the interior of said case member A, the mutual and relative idle distances or gaps between the resonator, vibrator and iron core can be established and maintained at prescribed precise values. With this, appreciable variation in the tone quality is substantially avoided among mass-produced contactless buzzers and the tone quality is stabilized.

The vibrator and the iron core may be arranged and maintained at their prescribed precise mutual position by the utilization of the positioning and assemblying stud posts grouped on the said two precisely parallel horizontal planes formed during the moulding fabrication of the case member A, the mutual magnetic coupling between the vibrator and iron core being highly stabilized. By the utilization of the said stud posts, an automatic assembly of the buzzer units is realized on a large scale production base.

In addition, the vibrator is fixedly positioned at a plurality of points distributed along and in close proximity to the outline yoke-like configuration and by the use of said positioning and connecting stud posts, the efficiency of vibration of the vibrator unit can be highly improved.

Since the contactless buzzer unit built according to this invention comprises a rather smaller number of constituent sub-assemblies which can be efficiently and reliably positioned and fixed to each other, a highly miniatured buzzer is provided without fabrication difficulty and without loss of the superior working efficiency of the buzzer.

Now turning to the electronic and electro-mechanical oscillator circuit employed in the foregoing embodiment of the invention, it should be noted in advance that the blocking oscillator employed herein can operate in a highly stabilized manner even with appreciable variation of the ambient temperature and in the supply voltage.

Figure 13:
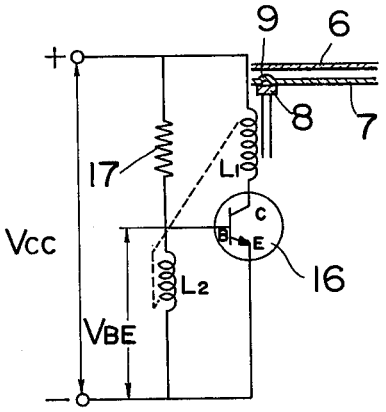
FIG. 13 is a schematic diagram of a conventional blocking oscillator circuit shown only for comparison purpose.

As was referred to briefly hereinbefore, the blocking oscillator shown in FIG. 13 comprises drive coil $L_1$, sensing coil $L_2$, oscillator transistor 16 and bias resistor 17.

Figure 14:
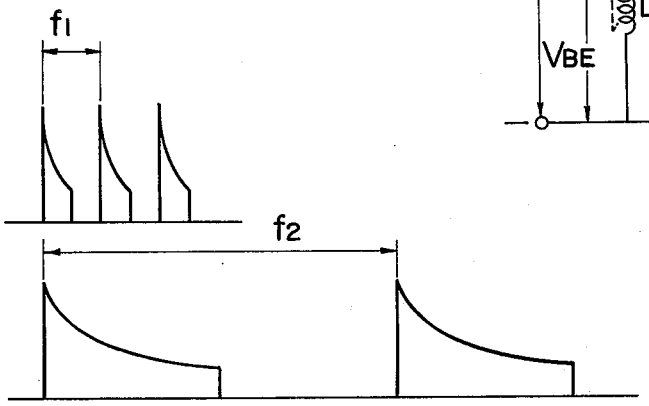
FIG. 14 is illustrative of a working wave curve appearing between a collector and an emitter of a transistor inserted in the conventional circuit shown in FIG. 13, being shown together with a working wave chart when considering as together with a vibrator.

When source current is fed as conventionally to the blocking oscillator shown, a positive feedback operation will occur between the coils $L_1$ and $L_2$, so as to produce and maintain an oscillation. By this blocking oscillation, a periodically interrupted current will be applied to the collector terminal of the transistor 16, thereby the iron core 11 is energized intermittently and periodically. Each time when the core 11 is energized, the permanent magnet or iron piece 8 attached to vibrator 7 positioned in close proximity to the iron core, is subjected to an attractive force. On the other hand, when the energization is interrupted, the attracting force is released. By repeating these operations, the vibrator 7 is brought into its oscillative operation. Upon initiation of the oscillative operation of vibrator 7, the oscillation frequency $f_1$ of the circuit is brought forcibly into coincidence with the resonance frequency $f_2$ of the vibrator by virtue of the variation of the magnetic reluctance and then a stabilized oscillation is established and maintained, as will become more apparent by review of FIG. 14.

Figure 15:
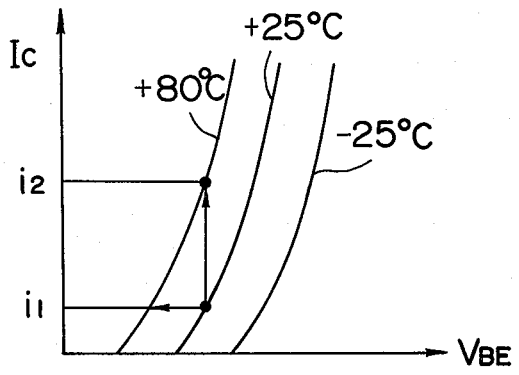
FIG. 15 is a $V_{BE}$-$I_C$ characteristic chart of a transistor.

Next, comparison will be made between the conventional circuit of FIG. 13 and the improved circuit of FIG. 8. With variation of source voltage $V_{CC}$, the voltage $V_{BE}$ between the base and emitter of transistor 16 in FIG. 13 will be subjected to alteration, thereby its operation point will correspondingly vary and unstable operation will occur. With an ambient temperature change, the $V_{BE}$ - $I_C$ characteristics will correspondingly vary, resulting in unstable oscillative operation. This unfavorable phenomenon is explained with reference to FIG. 15, showing the relationship between $V_{BE}$ - $I_C$ characteristics of a transistor and temperature variation. It is now assumed that the ambient temperature has shifted from +20°C to +80°C and the operating point by positioned initially at a point A'. Then, the operating point may shift from the point A' to a new point B' as shown by an arrow, thereby an excess current $i_2$ being caused to flow. Under this extreme condition, the oscillation could be unintentionally interrupted, even if the transistor conducts. Therefore, it will be seen that with use of the above conventional circuit shown in FIG. 13 by way of example, a stabilized operation with the aforementioned temperature range could not be expected.

Figure 16:
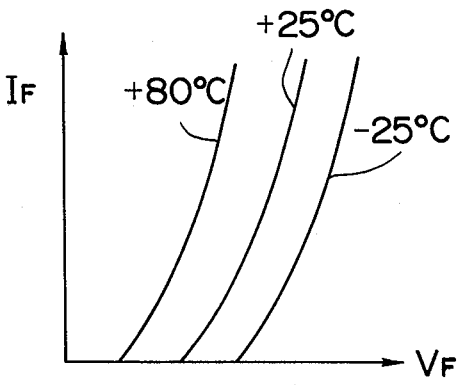
FIG. 16 is a $V_F$ - $I_F$ chart of a diode.

On the contrary, with use of the improved buzzer circuit shown in FIG. 8 wherein a diode at 18 is provided, the shifting direction of $V_F$ - $I_F$ characteristics of the diode with temperature variation is same as that of $V_{BE}$ - $I_C$ characteristics of the transistor as shown by way of example in FIG. 16, the working point will shift from the point A' to a new point C' for the same temperature variation from +25°C to +80°C as before, thereby a highly stabilized operation is assured. With a temperature shift from +25°C to a lower point, similar favorable temperature compensation will be assured by use of the above improved buzzer circuit.

In addition, a stabilized operation can also be assured by use of the above improved buzzer circuit by virtue of the constant voltage characteristic of the diode for voltage variation.

According to our experimental experience, a voltage range 4 – 8 volts or so for the rated voltage of 6 volts at temperature variation range of −10°C to +45°C may generally be assured with conventional buzzer circuits of the class shown in FIG. 13. With use of the improved buzzer circuit shown in FIG. 8, however, a highly stabilized operation can be assured between 2 and 25 volts or so at a rather widened temperature variation range of −45°C to +85°C. This result is a remarkable advance in the art.

It will therefore be seen that with use of the improved principles of the invention, high quality contactless buzzer units can be attained which have a stabilized tone quality without adjustment and are economical in their industrial mass production. In addition, they have a longer durable life.

Finally, it should be noted that the base electrode of transistor 16, FIG. 8, is connected with resistor 17 and sensing coil $L_2$, while the opposite end of said resistor is connected with positive voltage source, as being schematically shown. The opposite end of said sensing coil $L_2$ is connected through diode 18 with emitter electrode of said transistor, thereby providing a negative voltage source. As may be well acknowledged from the foregoing, the base plate 12, FIG. 7, serves as the magnetic flux-conducting means.

The embodiments of the invention in which an exclusive property or privilege is claimed are as follows:

1. A contactless buzzer unit having a case encasing a working coil, an iron core, a vibrator and a resonator, the resonator being brought into its resonating state by being struck by said vibrator, said vibrator being brought into an oscillating condition by periodical magnetization of said iron core by means of periodical energization of said coil, wherein:

said unit is characterized by said case being made from a plastic resin material by molding and representing first and second mutually parallel plane surfaces, each being formed with a plurality of depending stud posts; those posts formed integrally on said first plane surface serving as guide and fixing means for attaching an audible signal delivery means comprising said resonator, a spacer and said vibrator, to said case, and those posts formed integrally on said second plane surface serving as a guide and fixing means for attaching a base section comprised of a base plate mounting an electromagnetic drive unit comprising said iron core and said working coil.

2. The buzzer unit of claim 1, a bobbin on which said working coil is wound is provided with a projection mounted on each of upper and lower surface of said bobbin, a printed circuit is fitted with a transistor having related circuit elements electrically connected therewith and, formed with an opening for engagement with one of said projections, while the remaining opposite one of said projections is brought into engagement with a further opening formed on a base plate mounting said core and acting as magnetic flux-conducting means, thereby a prescribed relative positioning and fixing of said board relative to said base plate is assured.

3. The buzzer unit of claim 2 wherein said electromagnetic drive circuit comprises a drive coil and a sensing coil forming in combination said working coil, one end of said drive coil being electrically connected with the collector of said transistor and the opposite end of said drive coil being electrically connected with positive side of a voltage source, the base electrode of said transistor being connected with a resistor and said sensing coil, the opposite end of said resistor being electrically connected with said positive side of said voltage source, the opposite end of said coil being electrically connected through a forward biased diode to the emitter of said transistor, so as to provide a negative voltage source.

* * * * *